US006686821B2

(12) United States Patent
Suzuki

(10) Patent No.: US 6,686,821 B2
(45) Date of Patent: Feb. 3, 2004

(54) RELAY DEVICE

(75) Inventor: Hirohisa Suzuki, Nishio (JP)

(73) Assignee: Anden Co., Ltd., Anjo (JP)

( * ) Notice: Subject to any disclaimer, the term of this patent is extended or adjusted under 35 U.S.C. 154(b) by 0 days.

(21) Appl. No.: 10/094,620

(22) Filed: Mar. 12, 2002

(65) Prior Publication Data

US 2002/0125973 A1 Sep. 12, 2002

(30) Foreign Application Priority Data

Mar. 12, 2001 (JP) ..... 2001-069173
Mar. 1, 2002 (JP) ..... 2002-055855

(51) Int. Cl.[7] ..... H01H 67/02
(52) U.S. Cl. ..... 335/128; 335/202; 335/83
(58) Field of Search ..... 335/78–86, 124, 335/128–33, 202

(56) References Cited

U.S. PATENT DOCUMENTS 6,337,614 B1 * 1/2002 Tsutsui ..... 335/160
6,414,576 B1 * 7/2002 Nakamura et al. ..... 335/83

FOREIGN PATENT DOCUMENTS

EP 0531890 A1 * 9/1991 ..... 335/83

* cited by examiner

*Primary Examiner*—Lincoln Donovan
(74) *Attorney, Agent, or Firm*—Oblon, Spivak, McClelland, Maier & Neustadt, P.C.

(57) ABSTRACT

A relay device capable of reducing the manufacturing costs thereof by decreasing the number of parts and the number of electrical connections between these parts, and making the manufacturing process simple. The relay device has a plurality of electromagnetic relays and uses a common base plate with which stems of the electromagnetic relays are formed integrally, and on which a wiring member is formed by resin molding. The wiring member on the common base plate is projected from the molded resin to define a fixed contact member of each electromagnetic relay. Each relay unit assembly of each electromagnetic relay except for the fixed contact member thereof is secured to the common base plate such that a movable iron piece is driven in parallel with a surface of the common base plate. The construction of the resultant relay device is compact, the relay properties are readily adjusted, and the number of parts can be reduced.

4 Claims, 8 Drawing Sheets

RELAY DEVICE

BACKGROUND OF THE INVENTION

1. Field of the Invention

The present invention relates to a relay device.

2. Description of Related Art

A conventional relay circuit includes a plurality of relays which are electrically connected to each other, and is generally manufactured by preparing a wiring board on which a predetermined wiring is provided and to which a plurality of sockets for relays are secured, and fitting relays into respective sockets secured to the wiring board. Otherwise, such a conventional relay circuit may be manufactured by directly securing external connection terminals (contact terminals, coil terminals) to the wiring provided on the wiring board by soldering or the like method without using sockets.

As is well known, the conventional relay includes contact members composed of a movable contact member and a fixed contact member, a magnetic path member which generates magnetic force for driving the movable contact member, a coil which forms magnetic flux for driving the movable contact member in the magnetic path member, an electrically insulating stem for finally supporting the contact members, the magnetic path member, and the coil, and a wiring member (wiring member inside relay) which is formed integrally with the stem, and is electrically connected to both ends of the coil and the contact member with ends thereof serving as external connection terminals for connection with the outside.

In the conventional wiring board for relay circuit, normally, an electric current flowing through contacts of a relay is relatively large, as compared to that of a transistor, and accordingly, cables are normally wired along a rear surface (will be also referred to as an unpackaged surface) of the wiring board. As the coil current is relatively small, conductive patterns which are pattered on the wiring board may be also used.

Publication of Japanese unexamined patent application No. 2000-164098 which has been filed by the present applicant and is now pending proposes a relay in which a wiring member (wiring member inside relay) is formed integrally with a stem by so-called lead frame technique. However, in the above-described conventional relay device, there are many parts and many electrical connections between these parts, and the manufacturing process is complex so that it is difficult to reduce the manufacturing costs greatly.

Publication of Japanese unexamined patent application No. 2000-253539 proposes to form a fixed contact member of a relay by bending one part of a lead frame-like wiring member, and to arrange a plurality of relays on a common base plate which includes this wiring member. This relay device has adopted the arrangement that movable members of a relay unit move in the direction at right angles to a flat main surface of the common base plate, on which the relay unit is packaged, and accordingly, has the problem that the mechanical adjustment of the relay is very difficult after assembling thereof. Namely, in this relay device, the fixed contact member is composed of the wiring member on the common base plate, and accordingly, upon manufacturing the relay unit, it is impossible to perform the final mechanical adjustment of a gap between the fixed contact member and a movable contact member, or the like. Such mechanical adjustment must be performed after assembling the relay unit on the common base plate. This conventional relay device, however, has adopted the arrangement that the moving direction of the movable members such as the movable contact member is directed at right angles to the parts-packaged surface of the common base plate, and accordingly, when a jig (gauge) or the like is inserted into the above-described gap for the mechanical adjustment thereof, it must be inserted in oblique directions. In this case, other members may obstruct the insertion of the gauge to make the insertion work difficult. In addition, these obstructive members must be arranged in the positions spaced from the above-described gap, and accordingly, the overall device becomes undesirably great. These problems become remarkable where a plurality of relays are arranged on the common base plate. In particular, when a plurality of relays are arranged in one direction to make the directions in which the gauges are inserted for adjustment identical to each other, a wide idle space must be provided between adjacent relays for preventing the gauge inserted in an oblique direction from contacting other members.

Published Japanese Translation Publication (KOHYO) No. 10-505191 of PCT International Publication (No. WO96/08023) for Patent Application proposes to weld a fixed contact member of a relay, of which properties have been adjusted, to a bending projection of a wiring member, which projects from a common base plate. With the lead frame-type assembly relay device disclosed in this publication, a completed relay is mounted, and accordingly, the above-described mechanical adjustment (adjustment of contact gap) after assembling the relay is not required. In addition, the moving direction of a movable iron piece is determined at right angles to the surface of the common base plate, similarly to publication of Japanese unexamined patent application No. 2000-253539. Accordingly, the device of this publication has many parts and many electrical connections therebetween. With this arrangement, it is difficult to reduce the manufacturing costs further by making the manufacturing process simple.

SUMMARY OF THE INVENTION

It is an object of the present invention to provide a relay device capable of reducing the number of parts and the number of electrical connections between these parts, and making the manufacturing and adjusting works simple, thereby reducing the manufacturing costs thereof.

The relay device in accordance with the present invention will be explained.

The relay device in accordance with the present invention is characterized in that in a relay device which has a plurality of electromagnetic relays, each electromagnetic relay including contact members which are composed of a movable contact member and a fixed contact member, a magnetic path member which generates magnetic force for driving the movable contact member, a coil which forms magnetic flux for driving the movable contact member in the magnetic path member, an electrically insulating stem for finally supporting the contact member, the magnetic path member and the coil, and a wiring member which is formed integrally with the stem, and is electrically connected to both ends of the coil and the contact member with an end of at least one part of the wiring member serving as an external connection terminal for connection with the outside, stems of the plurality of electromagnetic relays are made integral with each other, and are composed of a common base plate which is made integral with the wiring member by resin-molding.

With the relay device in accordance with the present invention, the stems of the electromagnetic relays are made integral with each other. And accordingly, the stems, each being integrally formed with each wiring member by resin molding method or the like, can be manufactured by one molding work. Accordingly, the resin molding process can be greatly shortened, and the number of parts therefor can be reduced. And where other parts of the electromagnetic relays are mounted on the common base plate with which the stems are integrally formed, the packaged position thereof can be determined in designed positions on the common base plate with only one positioning work. Accordingly, the packaging work becomes easy. In addition, the connection of the external connection terminals provided on the common base plate with an external wiring can be performed by one connection work, and accordingly, the wiring work can be performed with ease. Furthermore, by merely securing this common base plate, the mounting work of each electromagnetic relay is completed, and accordingly, the electromagnetic relays can be mounted with ease.

In a preferred embodiment, the wiring member includes a terminal for fixed contact, which projects from the surface of the common base plate, on which parts are packaged, and act as the above-described fixed contact member. With this arrangement, an end of the wiring member of the common base plate serves as the fixed contact member, and accordingly, the connection of the fixed contact member and the wiring member, which has been conventionally required, can be omitted. Consequently, the number of parts and the connecting work decrease to make the manufacturing process simple, and improve the reliability of the relay device.

In another preferred embodiment, the terminal for fixed contact projects from the surface of the common base plate on which the electromagnetic relays are packaged, at approximately right angles thereto, and the movable contact member is secured to the terminal defined by an end of the wiring member, which projects from the surface of the common base plate, so as to contact and separate from the terminal for fixed contact. With this arrangement, the terminal for fixed contact, which acts as the fixed contact member, projects from the surface of the common base plate, on which the electromagnetic relays are packaged, at approximately right angles thereto. In addition, with this arrangement, the terminal for fixed contact, which is defined by the end of the wiring member, can be provided so as to stand approximately upright on the common base plate, and accordingly, the end of the wiring member which extends in parallel with the above-described surface of the common base plate can be readily formed into the fixed contact member, and the wiring member can be readily connected to the movable contact member, and a die for molding the common base plate can be readily manufactured. The bending work of the ends of the wiring member, which is used as the fixed contact member or the terminal for movable contact, may be performed by blanking a metal plate upon preparing the wiring member or thereafter. Otherwise, such bending work may be performed after resin molding of the common base plate.

In still another preferred embodiment, the coil and the magnetic path member are finally supported by the movable contact member. With this arrangement, the assembling of relays (except for the connection of the coil and the wiring member) can be completed by merely securing and connecting the movable contact member on which the coil and the magnetic path member have been previously mounted, to the wiring member (for connection with the movable contact member), which projects from the packaged surface of the common base plate, that is the common stem, by welding, or the like. Accordingly, the work for assembling relays can be made simple. The positioning of the coil and the magnetic path member on the common base plate can be omitted.

In a further preferred embodiment, the movable contact member includes a movable iron piece which is disposed so as to move in a direction approximately parallel with the above-described packaged surface of the common base plate. With this arrangement, the adjustment of the contact gap, or the like can be facilitated.

The mechanical adjustments of the relay properties such as the adjustment of a contact gap, which are to be performed after mounting of the electromagnetic relay unit on the common base plate, can be effected with ease. For example, gauges can be inserted into corresponding parts of the electromagnetic relay unit for the above-described adjustments, and accordingly, the adjustment work becomes easy. In addition, working spaces which conventionally have been required for the adjustments of the relay properties, can be omitted, and accordingly, the device can be made compact.

In preferred embodiments, the electromagnetic relay units are arranged in a line on the packaged surface of the common base plate. With this arrangement, the direction of the mechanical adjustment of the electromagnetic relay units can be made identical to each other, and accordingly, the mechanical adjusting operation can be made simple, and the above-described working space is not required to provide between electromagnetic relay units. Therefore, the device can be made small and light, and the length of a common wiring part between electromagnetic relay units can be made short.

Other objects, features, and characteristics of the present invention will become apparent upon consideration of the following description and the appended claims with reference to the accompanying drawings, all of which form a part of this specification.

DETAILED DESCRIPTION OF THE PRESENTLY PREFERRED EMBODIMENTS

A first embodiment of a relay device in accordance with the present invention will be explained with reference to accompanying drawings.

Figure 1:
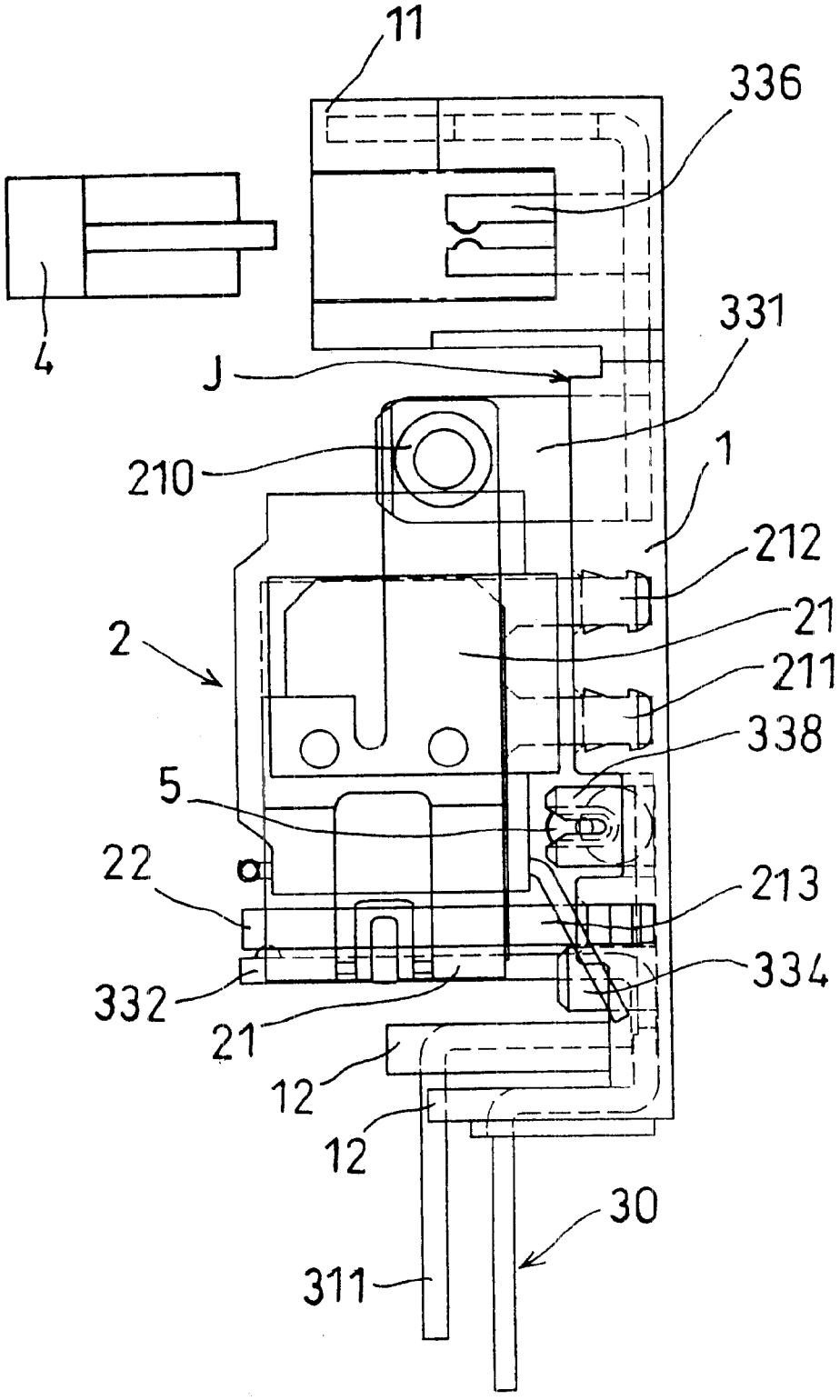
FIG. 1 is a side elevation view of one embodiment of a relay device from which a casing is removed, in accordance with the present invention.
Figure 2:
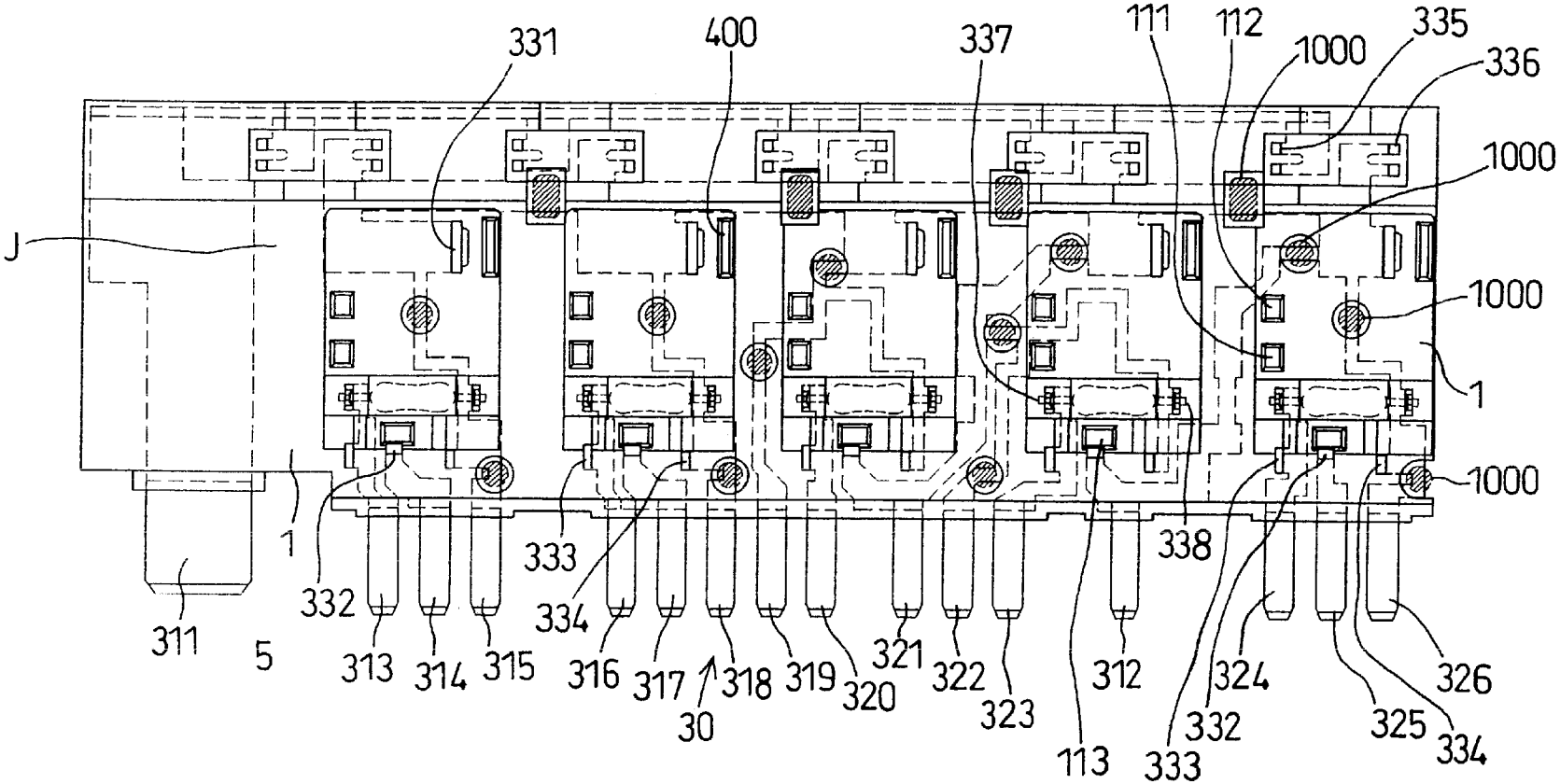
FIG. 2 is a front view of a common base plate and wiring members.
Figure 3:
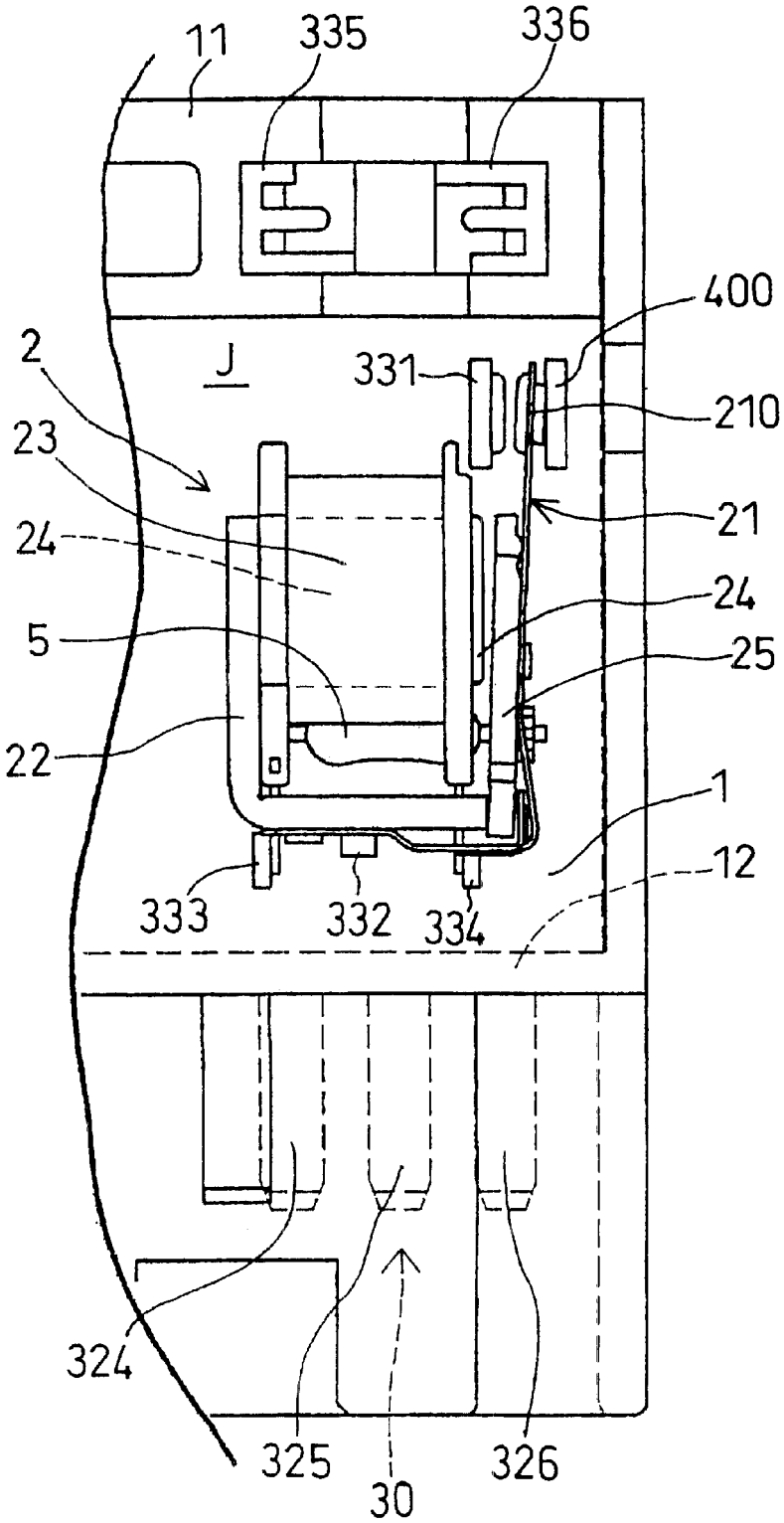
FIG. 3 is a front view of a relay unit.
Figure 4:
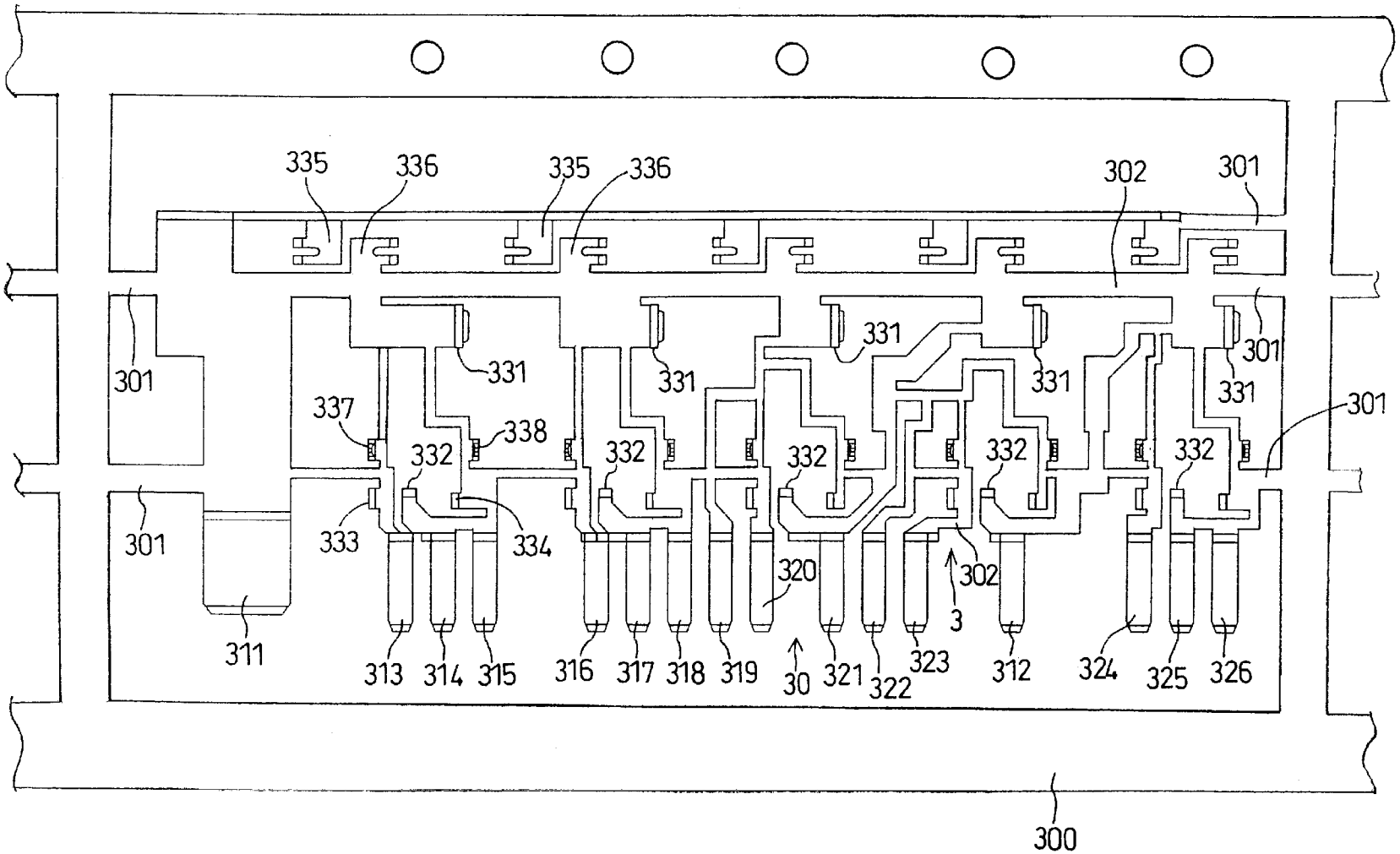
FIG. 4 is a front view of half-finished wiring members after press-blanking work.

The side elevation view of this relay device is shown in FIG. 1, the front view of a common base plate 1 and wiring members 3 is shown in FIG. 2, the front view of a relay unit 2 is shown in FIG. 3, and the front view of half-finished wiring members 3 is shown in FIG. 4.

As shown in FIG. 1, the common base plate 1 as a wiring board, which is composed of resin, has a generally rectangular and flat configuration, and includes a frontwardly opening window 11 for accommodating a fuse in an upper portion thereof, and a wall 12 which projects frontwardly from a surface J of the base plate 1 on which parts are to be packaged, in a lower end thereof.

Five sets of relay circuits, each being composed of one relay unit 2, one fuse 4 and one resistor 5, are arranged on the surface J of the common base plate 1.

Wiring members 3 (FIG. 4), each extending into a predetermined configuration, are integrally formed with the common base plate 1.

The wiring members 3 mean required number of plate-like wiring members (also referred to as bus bars), which are composed of a copper alloy. Most part of each wiring member (bus bar) except for ends thereof is embedded in the common base plate 1 in nearly parallel with the surface of the common base plate 1, on which parts are packaged.

Ends of the wiring members 3 partly project downwardly from the wall 12 of the common base plate 1, thereby defining external connection terminals 30. Each of the external connection terminals 30 includes a power supply terminal 311, earth terminal 312, coil terminal which connects a coil of the relay unit 2 to the outside, and relay terminals 313 to 326, each being composed of a contact terminal which connects a later-described fixed contact member and movable contact member to the outside. These power supply terminal 311, earth terminal 312 and relay terminals 313 to 326 compose external connection terminals of the present invention.

Another part of the ends of the wiring members 3 project from the surface J of the common base plate 1 at right angles thereto, thereby composing internal connection terminals. These internal connection terminals include five sets of a terminal 331 for fixed contact as a fixed contact member, a terminal 332 for movable contact, which is to be welded to a terminal of a movable contact of the relay unit 2, and terminals 333 and 334 for coil connection, to which both ends of the coil of the relay unit 2 are to be respectively connected. In addition, five pairs of terminals 335 and 336 for fuse, which support both ends of the fuse 4, and terminals 337 and 338 for resistor, which support both ends of the resistor 5, are also formed.

The relay unit 2 will be explained in more detail.

The relay unit 2 has the construction that fixed contact members and stems of an electrical insulating material are omitted from a normal electromagnetic relay, and composes a single contact-type electromagnetic relay which has a fixed contact member composed of the terminal 331 as an end of one of the wiring members 3, and a rocking type movable contact along with the common base plate 1 as a stem.

The terminal 331 as the fixed contact member projects from the common base plate 1 at right angles thereto. A metal for contact is built up on a contact of the terminal 331.

Each relay unit 2 has a movable contact member 21 which is provided on the surface J into an L-shaped configuration, a yoke (magnetic path member) 22 composed of a soft iron plate, which is provided on the surface J into a plate-shaped and L-like configuration, a fixed core (magnetic path member) 24 composed of a columnar soft iron material, which is inserted into a bobbin on which a later-described coil 23 is wound, a movable iron piece (magnetic path member) 25 composed of a plate-shaped soft iron material, and the coil 23 which is wound on the bobbin to form magnetic flux in the magnetic path member 22.

The movable contact member 21 having an L-shaped configuration is composed of a fixed side part and a rocking side part which extends from one end of the fixed side part at right angles to the fixed side part, and is formed by blanking a thin plate of phosphor bronze, and bending a blanked plate at right angles. A metal for contact is built up on an end 210 of the rocking side part of the movable contact member 21 so as to face the contact (fixed contact) of the terminal 331, thereby defining a movable contact.

The movable iron piece 25 is secured to the rocking side part of the movable contact member 21 in close contact therewith, and extends along the rocking side part of the movable contact member 21. One side of the L-shaped yoke 22 is secured by caulking to the fixed side part of the movable contact member 21, and the other side of the L-shaped yoke 22 extends from an end of the fixed side part of the movable contact member 21, which is opposite to the rocking side part of the movable contact member 21 in approximately parallel with the rocking side part of the movable contact member 21 and the movable iron piece 25. Consequently, the movable iron piece 25 and the yoke 22 are arranged into a U-like configuration such that the other side of the yoke 22 and the movable iron piece 25 magnetically short-circuit with each other. And the fixed core 24 into which the coil 23 is inserted is fixed to the other side of the yoke 22. Accordingly, the L-shaped yoke 22, the fixed core 24 and the movable iron piece 25 define a ring-like closed magnetic circuit having a gap between the movable iron piece 25 and the fixed core 24. The movable contact member 21 which has excellent elasticity ensures the above-described gap. Reference numeral 400 denotes a stopper member which is inserted into the common base plate 1 for limiting the displacement of the movable contact member 21 so as to prevent the above-described gap from becoming greater than a predetermined amount.

Figure 5:
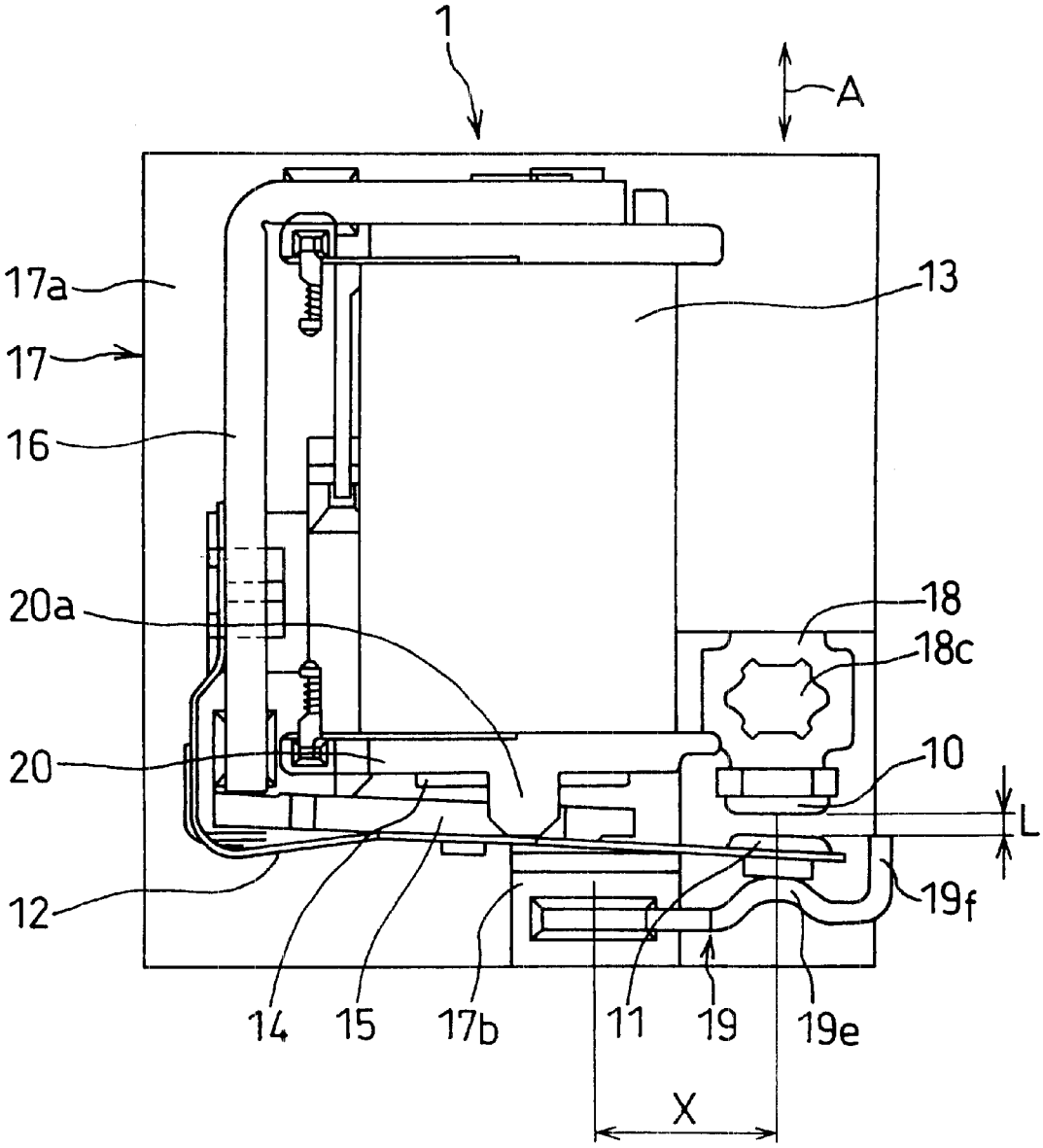
FIG. 5 is a front view of one part of a second embodiment of a relay device in accordance with the present invention.

The terminal 332 for movable contact, which is defined at an end of the wiring member 3 for connection to the movable contact member 21, projects from the common base plate 1 at right angles thereto closely or adjacently to the fixed side part of the movable contact member 21, and in the example illustrated in FIG. 5, the terminal 332 extends in a direction parallel with the surface of the common base plate, and projects such that a metal part thereof is exposed. The fixed side part of the movable contact member 21 is secured to the terminal 332 for movable contact by welding or the like method. The yoke 22 has a pair of legs 211 and 212 which project towards the common base plate 1, and a leg 213 which is slightly spaced from the legs 211 and 212. The legs 211 and 212 are press-fitted into depressions 111 and 112 which are formed in the common base plate 1 respectively. And the leg 213 is press-fitted into a depression 113 which is formed in the common base plate 1. Consequently, the movable contact member 21 and the yoke 22, which respectively have an L-like configuration, and are secured to each other by caulking, are supported at three points on the common base plate 1.

Upon supplying an electric current to the coil 23, the movable iron piece 25 is attracted by the fixed core 24, and the rocking side part of the movable contact member 21, to which the movable iron piece 25 is secured, rocks on a corner of the movable contact member 21 between the fixed contact side part and the rocking side part thereof in parallel with the surface J, and comes into close contact with the terminal 331 for fixed contact, that is the fixed contact member in accordance with the present invention. Upon interrupting the supply of an electric current to the coil 23, the magnetic force acting on the movable iron piece 25 disappears, and the rocking side part of the movable contact member 21 separates from the terminal 331 for fixed contact due to its elastic force.

The characteristic of this relay unit 2 is that one side of the yoke 22 and the movable iron piece 25 are secured to the movable contact member 21, the fixed core 24 is secured to the other side of the yoke 22, and the coil 23 mounted around the bobbin is mounted on the fixed core 24. Namely, finally, the magnetic path members and the coil 23 of the relay unit 2 are supported by the movable contact member 21. Accordingly, by preparing the relay unit 2 in which the magnetic path members and the coil 23 are previously supported by the movable contact member 21, and setting the prepared relay unit 2 in a predetermined position on the common base plate 1, press-fitting the legs 211 and 212 of the yoke 22 into two depressions, and welding the movable contact member 21 and the terminal 332 for movable contact to each other, a normal electromagnetic relay which includes the fixed contact member, the stem and the relay unit 2 can be completed.

The terminals 333 and 334 for connection with coils are composed of ends of the wiring members 2. These terminals 333 and 334 are formed on the surface of the common base plate 1 so as to project therefrom at right angles thereto, and both ends of the coil 23 are wound around and connected to the terminals 333 and 334.

The terminals 335 and 336 for supporting both ends of the fuse 4 are projected from the common base plate 1. Both ends of the fuse 4 are formed into a plate-like configuration, respectively, and are held by forked ends of the terminals 335 and 336.

Terminals 337 and 338 for supporting both ends of the resistor 5 are formed so as to project from the common base plate 1. Both ends of the resistor 5 are respectively held by forked ends of the terminals 337 and 338. Reference numeral 1000 denotes blanked parts provided for cutting tie bars.

Hereinafter, the manufacturing method of the above-described relay device will be explained. A blanked piece for forming wiring members 3 is illustrated in FIG. 4.

Each wiring member composing the wiring members 3 is integrally connected to a rectangular frame part 300 which surrounds the wiring members 3 with external tie bars 301, and integrally connected to other wiring members with internal tie bars 302 which will be cut and removed later. Then, a common base plate 1 is formed by subjecting predetermined portions of these wiring members 3 to resin molding. And by cutting and removing the external tie bars 301 and internal tie bars 302, the wiring of the wiring members 3 is competed. Next, by press-fitting the resistor 5 into the terminals 337 and 338, the resistor 5 is held by these terminals 337 and 338, and, similarly, the fuse 4 is held by the terminals 335 and 336. Then, the relay unit 2 which has been previously assembled in the above-described method is mounted on the common base plate 1, and the movable contact member 21 is welded to the terminal 332 for movable contact. Finally, the common base pate 1 on which circuit parts are packaged is accommodated in a casing (not shown) to finish the assembly of the relay device. The power supply terminal 311, earth terminal 312 and relay terminals 313 to 326, which are the external connection terminals in the present invention, act as connectors of the above-described casing.

Operational Advantage

Hereinafter, other operational advantages effected by the present embodiment will be explained.

With the present embodiment, parts of the wiring members except for ends thereof are provided on a surface of the common base plate as a wiring board so as to extend in approximately parallel therewith, and there is provided a bus bar for electrically connecting electromagnetic relays to each other. Namely, the common base plate, that is an integral common stem of each electromagnetic relay, includes a built-in wiring for connecting electromagnetic relays to each other, thereby defining a so-called wiring board. With this arrangement, such a wiring board required in the conventional relay device can be substantially omitted, and accordingly, the relay device can be miniatured, and the number of parts and the number of electrical connecting points in wiring can be decreased. In addition, the manufacturing process and the manufacturing costs can be reduced.

Furthermore, in the present embodiment, by pressing a flat metal plate, a blanked product for wiring members is formed, by making the banked product integral with the stem by resin molding, the wiring members are extended in parallel with a surface of the stem, by cutting connecting parts of the blanked product away therefrom, each wiring member is made independent thereof, and by bending an end of each wiring member at approximately right angles to the surface of the stem so as to project outwardly therefrom, the fixed contact member is defined. With this arrangement, the terminal for fixed contact, and the facing terminal for movable contact, which is provided in the movable contact member can be arranged so as to stand upright from the common base plate, and consequently, the fixed contact member can be manufactured simply by bending the end of each wiring member at right angles, whereby the manufacturing process can be made simple.

In addition, with the present embodiment, by securing the movable contact member on which the magnetic path members and the coil are supported, to the terminal for movable contact, which is provided in the wiring member such that one end of the movable contact member extends at right angles to the surface of the stem, and faces the fixed contact member so as to be able to come into contact with the fixed contact member and separate therefrom, the movable contact member, the magnetic path members and the coil are secured to the stem. Consequently, by merely securing and connecting the movable contact member on which the coil and the magnetic path members have been previously mounted, to the wiring member (for connection of the movable contact member) which projects from the surface of the stem, with welding, for example, the assembling of the relay (except for the connection between the coil and the wiring member) can be completed. Thus, the assembling work can be made simple, and the positioning work of the coil and the magnetic path members on the common base plate can be omitted.

Figure 6:
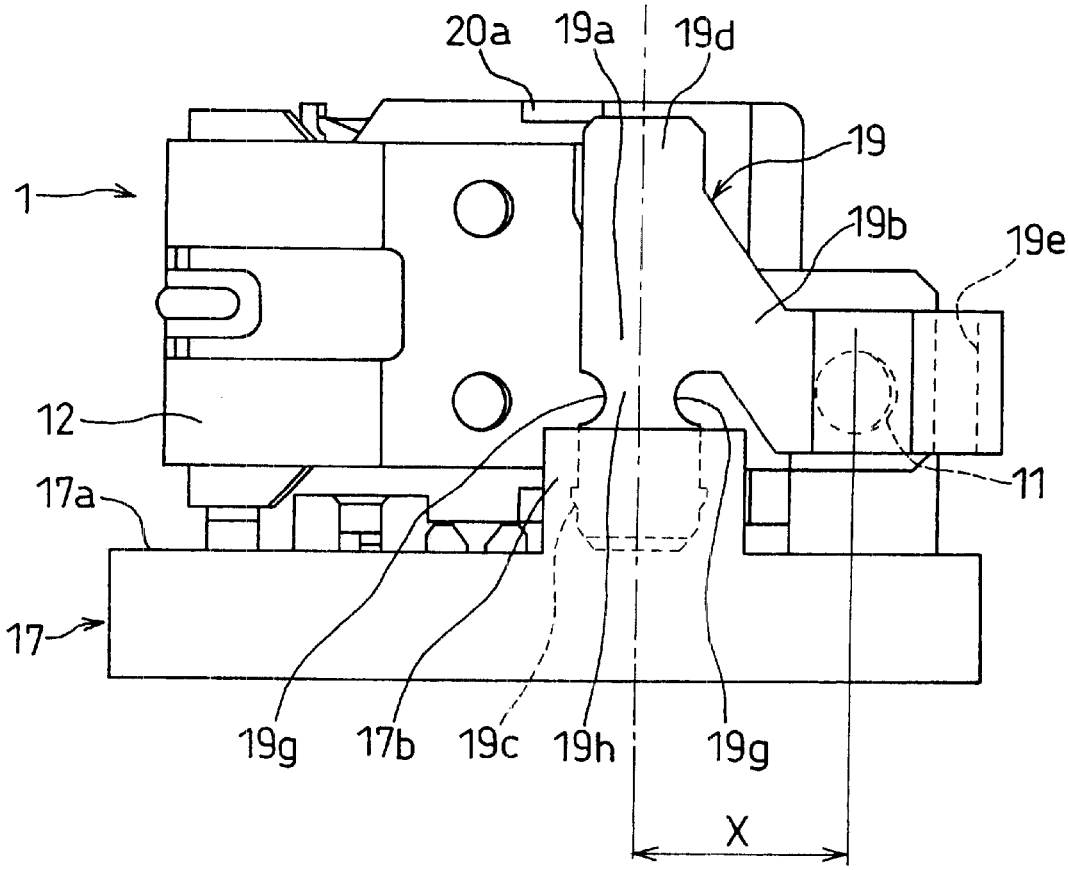
FIG. 6 is a bottom view of one part of the relay device of FIG. 5.

A second embodiment of a relay device in accordance with the present invention will be explained with reference to FIGS. 5 to 8. The reference numerals and characters which are used in these drawings for explaining the present embodiment are not related to those which were used in FIGS. 1 to 4 for explaining the first embodiment. FIG. 5 is a front view of a relay device of the present embodiment, and FIG. 6 is a bottom view thereof. In FIG. 5, only one relay is illustrated. Actually, a plurality of relays are packaged on a common base plate 17.

Construction

Reference numeral 10 designates a fixed contact, 11 designates a movable contact which faces the fixed contact 10 so as to be able to come into contact with and separate from the fixed contact 10. Reference numeral 12 designates a leaf spring to which the movable contact 11 is secured. The leaf spring 12 elastically biases the movable contact 11 in a direction away from the fixed contact 10, and defines a current-carrying route to the movable contact 11.

Reference numeral 13 designates a coil, 14 designates a fixed iron core, 15 designates a movable iron piece, 16 designates a yoke, 17 designates a common base plate, and 17*a* designates a surface on which parts are packaged. The movable contacts 11 and the movable iron piece 15 are fixed to the leaf spring 12. The fixed iron core 14 around which the coil 13 is wound, the leaf spring 12, and the like are made integral with the yoke 16 to define a relay unit. The relay unit is secured to the common base plate 17 by press-fitting the yoke 16 into the surface 17*a* of the common base plate 17.

Reference numeral 18 designates a holding member composed of a metal plate member, which is secured to the surface 17*a* of the common base plate 17, and defines a current-carrying route leading to the fixed contact 10. The fixed contact 10 is secured to one end of the holding member 18. The holding member 18 has the arrangement that one end of a lead frame (not shown in FIG. 5) which is embedded in the common base plate 17 is bent toward the surface 17*a* and is projected therefrom.

Reference numeral 17*b* designates a stopper attaching part which is formed integrally with the common base plate 17 by resin-molding so as to project from the surface 17*a*. A base end of a stopper 19 composed of a metal piece is press-fitted into a groove formed in the stopper attaching part 17*b*. The stopper 19 extends along the surface 17*a* on the opposite side of the fixed contact 10 with the movable contact 11 interposed therebetween, and contacts a rear surface of the movable contact 11 to define a maximum gap between the fixed contact 10 and the movable contact 11 in the stopping position of the movable contact 11.

The moving direction A of the movable contact 11 is determined in parallel to the surface 17*a*, and the mounting directions of the yoke 16 and the stopper 19 on the surface 17*a* are respectively perpendicular to the surface 17*a* and the moving direction A. Reference character X designates the distance between the position in which the stopper 19 is mounted on the common base plate 17 (stopper mounting position), and the position in which the stopper 19 abuts the movable contact 11. This stopper mounting position is away from the stopper abutting position in a generally moving direction A by the above-described distance.

The stopper 19 includes a first plate part 19*a* and a second plate part 19*b*. As shown in FIG. 6, the first plate part 19*a* is provided so as to stand on the common base plate 17 in the direction away from the surface 17*a*, and one end of the first plate 19*a* is press-fitted into the common base pate 17 as a press-fitting part 19*c* while the other end thereof is engaged with a later-described jig as an engaging part 19*d*. As shown in FIG. 6, the second plate part 19*b* is provided so as to extend from the first plate part 19*a* toward the movable contact 11 along the surface 17*a*, and includes an abutting part 19*e* which curves toward the movable contact 11 in the position facing the movable contact 11 for abutment to the movable contact 11 when the supply of electric current is interrupted. Reference numeral 19*f* designates a projection which is formed at an end of the second plate part 19*b* so as to extend toward the movable contact 11. The first plate part 19*a* has notches 19*g* which are formed just above the press-fitting part 19*c*, and a narrow part 19*h* of which the width is made narrow with the notches 19*g*.

Operation

Upon directing an electric current to the coil 13, similarly to the case of a normal electromagnetic relay, the movable iron piece 15 is attracted by the fixed iron core 14 with the electromagnetic attracting force of the coil 13, and the movable contact 11 abuts the fixed contact 10 to bring the relay into a conducting state.

Adjustment of Contact Gap L

Hereinafter, the method for adjusting a contact gap L will be explained.

Figure 7:
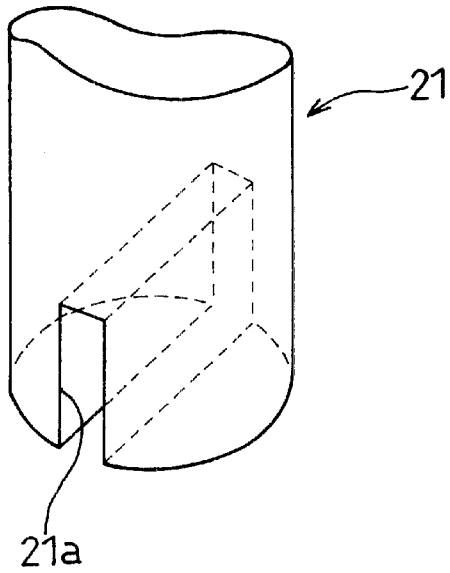
FIG. 7 is a perspective view of a jig for adjustment of gaps between contacts, which is used in Embodiment 2.

A jig 21 illustrated in FIG. 7 is a rod-like tool having a circular cross-section, which is used to twist the first plate part 19*a* of the stopper 19. An end of the jig 21 has a groove 21*a* for holding the engaging part 19*d* of the first plate part 19*a*.

In order to adjust the contact gap L, a gauge (not shown) having a thickness identical to a desired width of the contact gap L is inserted between the fixed contact 10 and the movable contact 11 from the upper side thereof toward the surface 17*a*, the jig 21 is inserted from the upper side thereof toward the surface 17*a*, and the engaging part 19*d* of the first plate part 19*a* is inserted into the groove 21*a*.

Next, by turning the jig 21, the first plate part 19*a* is twisted in the narrow part 19*h* of which the rigidity is small, the abutting part 19*e* of the second plate part 19*b* displaces toward the movable contact 11, and the contact gap L decreases. And when the movable contact 11 abuts the gauge, the twisting of the jig 21 is stopped. With this arrangement, the contact gap L is adjusted to the size slightly greater than the thickness of the gauge (contact gap L) due to the influence of the spring-back.

Figure 8:
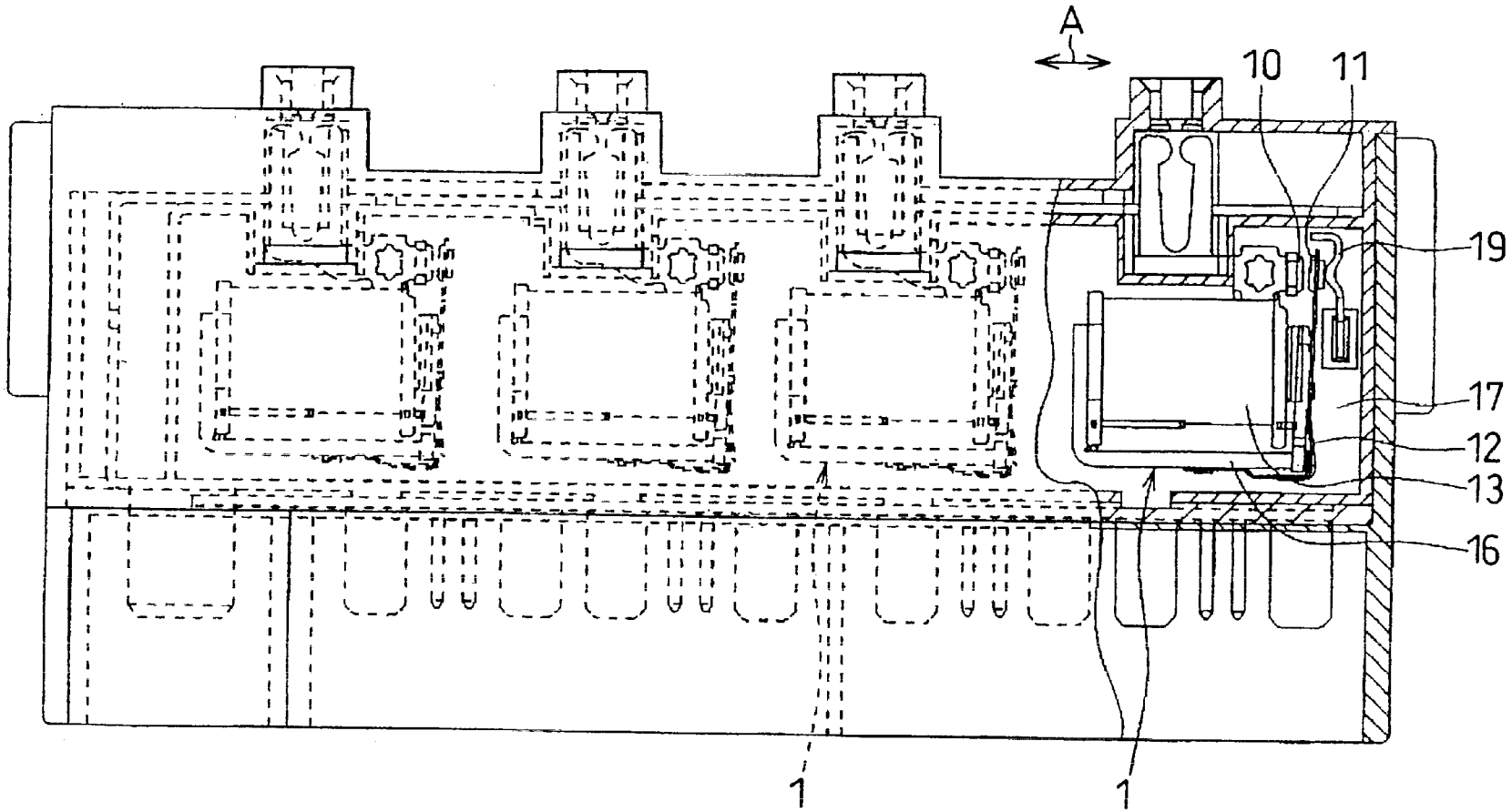
FIG. 8 is a plan view of an overall relay device of Embodiment 2.

With this adjusting method of the contact gap L, the contact gap L can be adjusted with the insertion and extraction of the jig 21 and the gauge in the direction perpendicular to the surface 17*a*, and the twisting of the jig 21, and accordingly a wide working space is not required around the relay unit. Even where a large number of relays are packaged on the common base pate 17 densely, the contact gap L between the fixed contact 10 on the side of the common base plate 17, and the later mounted movable contact 11 can be readily adjusted after mounting of the relay unit. The contact gap L may be adjusted by various well known methods other than the above-described method. FIG. 8 illustrates the case where four relays 1 are arranged on the common base plate 17.

Modified Embodiment

Figure 9:
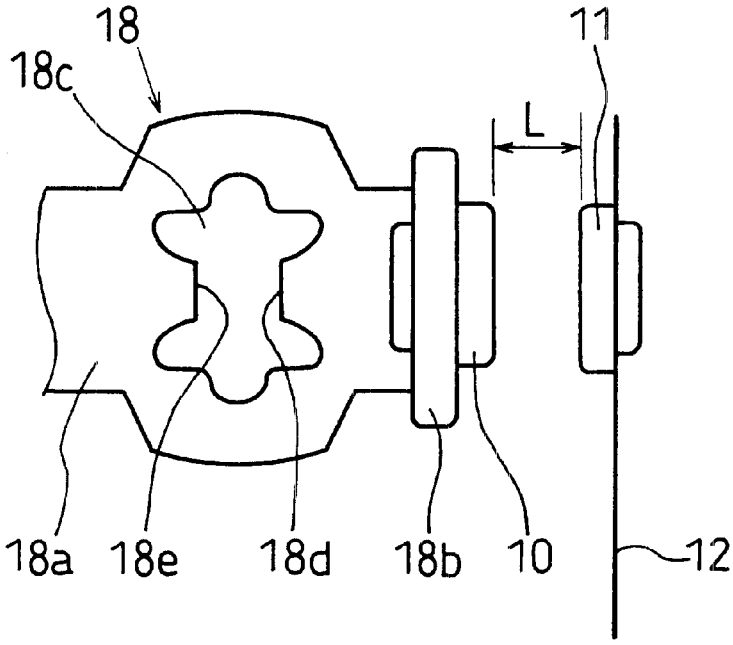
FIG. 9 is a partially enlarged plan view of a modified embodiment of Embodiment 2.
Figure 10:
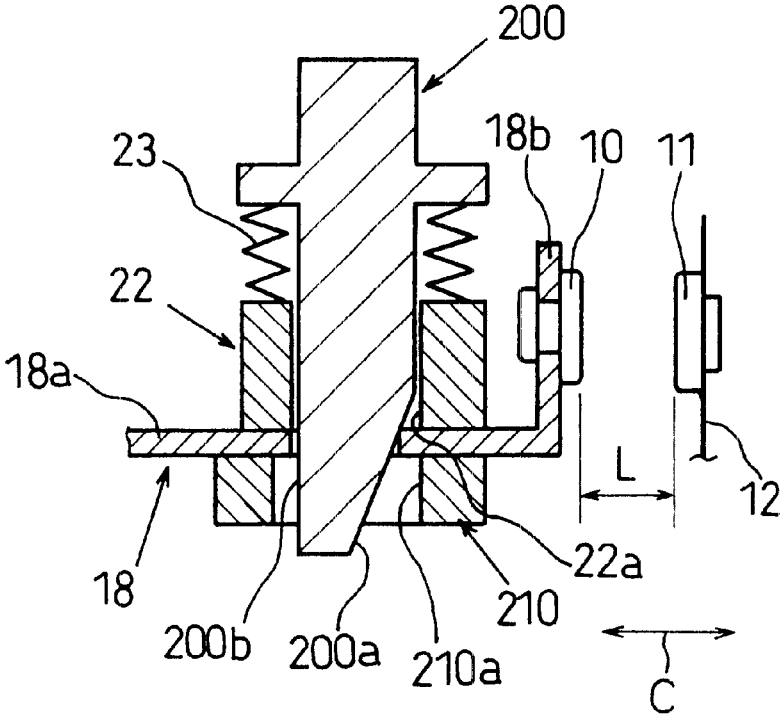
FIG. 10 is a partially enlarged longitudinal sectional view of a modified embodiment of Embodiment 2.

In the preceding embodiment, the method of adjusting the contact gap L using the deformation of the stopper 19 has been explained. Of course, the contact gap L may be adjusted by deforming the holding member 18 which supports the fixed contact 10. The adjusting method using the deformation of the holding member 18 will be explained with reference to FIGS. 9 and 10. The holding member 18, the fixed contact 10, the movable contact 11 and the leaf spring 12 which are illustrated in FIG. 9 are arranged, similarly to the arrangement of FIG. 5.

The holding member 18 has a first plate member 18*a* which is partly embedded in the common base plate 17 (not shown), projects from the common base plate 17, and extends in parallel with the surface 17*a* toward the movable contact 11, and a second plate part 18*b* which extends from an end of the first plate part 18*a* in the direction away from the surface 17*a*, and the fixed contact 10 is secured to the second plate part 18*b* and faces the movable contact 11 with the contact gap L interposed therebetween. The first plate part 18*a* has an aperture 18*c* which is partly defined by reference surfaces 18*d* and 18*e* extending in the direction C perpendicular to the direction of the contact gap L and the surface 17*a*.

Reference numeral 200 designates a tool, 210 designates a support jig, 22 designates a pressure jig, and 23 designates a spring.

The tool 200 acts to deform the aperture 18*c*, a flat surface 200*a* thereof, which abuts the reference surface 18*d* of the aperture 18*c*, inclines to the direction of the contact gap, and the flat surface 200*b*, which abuts the reference surface 18*e* of the aperture 18*c*, is formed vertically to the direction C of the contact gap.

First, the first plate part 18*a* is held and retained in the direction of thickness thereof with the support jig 210 and pressure jig 22, each having an aperture 210*a* or 22*a*, the jig 200 is inserted into these apertures 22*a*, 18*c* and 210*a* from the upper side thereof, and the flat surfaces 200*a* and 200*b* of the tool 200 are abutted to the reference surfaces 18*d* and 18*e* of the aperture 18*c*. Then, by pushing the tool 200 further, the aperture 18*c* is enlarged such that the distance between the reference surfaces 18*d* and 18*e* increases, and accordingly, the second plate part 18*b* as a free end moves toward the movable contact 11, and the fixed contact 10 approaches the movable contact 11. With this arrangement, the pushing of the tool 200 may be stopped when the contact gap L becomes a desired size.

With this adjustment method of the contact gap L, the contact gap L can be adjusted by pushing the tool 200 vertically to the surface 17*a*. In addition, before pushing the tool 200, the gauge for determining the contact gap L between the fixed contact 10 and the movable contact 11 can be pushed toward the surface 17*a* at right angles thereto. Accordingly, it is unnecessary to provide a wide working space around each relay, and even where a large number of relays are packaged on the common base plate 17 densely, the contact gap L between the fixed contact 10 on the side of the common base plate 17 and the movable contact 11 which has been secured later can be adjusted readily after mounting the relay unit.

While the invention has been described in connection with what are considered to be the preferred embodiments, it is to be understood that the invention is not limited to the disclosed embodiment, but, on the contrary, is intended to cover various modifications and equivalent arrangements included within the spirit and scope of the appended claims.

What is claimed is:

1. A relay device comprising:

a plurality of electromagnetic relays, each of said electromagnetic relays having contact members which include a movable contact member and a fixed contact member;

a magnetic path member which generates magnetic force for driving said movable contact member;

a coil wound around said magnetic path member, which forms magnetic flux for driving said movable contact member in said magnetic path member;

an electrically insulating stem for finally supporting said contact members, said magnetic path member and said coil; and a wiring member which is formed integrally with said stem and is electrically connected to both ends of said coil; and said contact members, one end of at least one part of said wiring member serving as an external connection terminal for connection with the outside, wherein said electromagnetic relays, are comprise stems integral with each other, and formed of a common base plate which is resin molded with said wiring member to form an integral unit, said wiring member projecting from a surface of said common base plate, on which parts composing said relay device are packaged, to define a fixed contact terminal as said fixed contact member.

2. A relay device as claimed in claim 1, wherein said fixed contact terminal projects from said surface of said common base plate at approximately right angles thereto, and said movable contact member is secured to a movable contact terminal which is composed of a projecting portion of said wiring member configured to project from said surface of said common base plate, such that said movable contact member faces said terminal for fixed contact so as to contact and separate from said terminal for said fixed contact.

3. A relay device as claimed in one of claims 1 and 2, wherein said movable contact member has a movable iron piece which is movably arranged on said surface of said common base plate in approximately parallel therewith.

4. A relay device as claimed in claim 1, wherein said wiring member electrically connects said plurality of electromagnetic relays.

* * * * *